US006899755B2

(12) United States Patent
Perlman

(10) Patent No.: US 6,899,755 B2
(45) Date of Patent: May 31, 2005

(54) COMPOSITION AND METHOD OF FORMING SAND SCULPTURES

(75) Inventor: Daniel Perlman, Arlington, MA (US)

(73) Assignee: Sandsmart, Inc., Boca Raton, FL (US)

( * ) Notice: Subject to any disclaimer, the term of this patent is extended or adjusted under 35 U.S.C. 154(b) by 256 days.

(21) Appl. No.: 10/184,705

(22) Filed: Jun. 28, 2002

(65) Prior Publication Data

US 2004/0000739 A1 Jan. 1, 2004

(51) Int. Cl.[7] ..... C08K 3/36; C08L 1/26; C08L 1/08; C08L 3/04; C08L 3/02

(52) U.S. Cl. ..... 106/163.01; 106/170.57; 106/204.3; 106/207.1; 106/217.3; 106/217.9

(58) Field of Search ..... 106/163.01, 170.57, 106/204.3, 207.1, 217.3, 217.9

(56) References Cited

U.S. PATENT DOCUMENTS 2,974,048 A * 3/1961 Sietsema ..... 106/38.51
2,977,236 A * 3/1961 Neukom ..... 106/38.51
3,086,874 A * 4/1963 Wallace et al. ..... 106/38.51
5,718,750 A * 2/1998 Weggel ..... 106/134.2

OTHER PUBLICATIONS

Condensed Chemical Dictionary, Hawley et al, p. 817, Feb. 1974.*

* cited by examiner

*Primary Examiner*—David Brunsman
(74) *Attorney, Agent, or Firm*—Weingarten, Schurgin, Gagnebin & Lebovici LLP

(57) ABSTRACT

A sand sculpting composition including approximately 100 parts by dry weight of sand, between 0.1 part and 5 parts by dry weight of at least one non-toxic cold water-soluble adhesive agent selected from the group consisting of pre-gelatinized starches, chemically modified starches and chemically modified celluloses, and between 6 and 25 parts by weight water. The adhesive agent has been combined with the sand and an amount of water sufficient to both dissolve the adhesive agent and allow the adhesive agent to coat the particles of sand. A coloring agent may be added to the adhesive agent.

30 Claims, No Drawings

COMPOSITION AND METHOD OF FORMING SAND SCULPTURES

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates to sand sculptures, particularly to cold water-soluble non-toxic adhesive materials that facilitate the building of sand sculptures, and more particularly to the selection of particular adhesives that are easy to use and provide strength to sand sculptures as they dry, while subsequently allowing the sand sculptures to be broken down by rain, by submersion in the rising tide or by exposure to any other source of water.

Devices and compositions for facilitating sand sculpting have been described in the prior art.

Demarzo in U.S. Pat. No. 6,126,876 describes a system for creating a mold and using that mold with successive additions of sand and water to form a packed column of sand for sculpting.

Kelly et al. in U.S. Pat. No. 5,730,293 describe a product using a dry granular treated sand, e.g., a specialized non-wettable sand, that retains its cohesiveness when submerged in water. A compressible receptacle is used for allowing a cohesive mass of such treated sand to be forced out of a nozzle immersed in water.

Browning in U.S. Pat. No. 5,711,795 describes a sand-based molding composition that is formed by combining a solvent, a waxy binder, and sand. The solvent is removed to leave the wax-coated sand that can be compressed to form a molded article.

Weggel in U.S. Pat. No. 5,718,750 describes a non-toxic sand additive including either gelatin, ordinary cooking flour or corn starch that improves the adhesion of ordinary sand, and that is mixed with a small quantity of water to form a sticky paste which is then mixed with beach sand for building sand sculptures. The preferred embodiment of the additive includes gelatin, salt and sand.

A keyword search of the terms "sand and cornstarch" or "sandcastle" provided a number of Internet addresses such as <www.bydonovan.com/sand.html> and www.kidssdomain.com/craft/sandtreasure.html> that describe the combination of corn starch, sand and water with or without the addition of alum. Unlike the cornstarch mixture of Weggel, the cornstarch-sand mixture described herein is cooked, and the resulting mixture thickens and becomes tacky, causing adhesion of the sand particles for sand sculpting.

While some of the above references describe environmentally friendly and non-toxic combinations of ingredients for sand sculpting, each composition or method of utilizing the composition has limitations that are explained in detail below.

BRIEF SUMMARY OF THE INVENTION

The present invention features adhesive-containing sand-based compositions and methods for their use in sand sculpting. The adhesive compositions contain at least one cold water-soluble adhesive that is non-irritating to the skin, non-toxic, environmentally non-polluting, and cost-effective. When an appropriate amount of the additive is mixed with sand and the sand is moistened with an adequate but not excessive amount of either cold or warm water, the adhesive causes cohesion of the sand particles. This cohesion is enhanced by either compressing the sand with ones hands or by pressing the sand into a shaped mold to bring the sand particles into close contact with one another. Upon exposure of the compressed and shaped sand form to air and sun, moisture begins to evaporate and the sand hardens. This hardening begins on the exterior surface and progresses throughout its volume to provide a strong sand sculpture. The three-dimensional sculpture may be preserved indefinitely in the absence of water.

The moistened adhesive-containing sand-based composition may also be applied to, and manipulated on a substantially flat and flexible, or alternatively rigid surface such as a canvas, cardboard or wooden support surface. In this manner, following drying, a substantially permanent two dimensional sand treatment such as a sand painting or bas-relief surface may be created. On the other hand, the present invention is also intended for creating temporary sculptures, sand castles and the like at the beach or in a sandbox, where the sculptures are intended to be washed away. In that event, soaking the hardened sand sculpture with a liberal amount of water provided by the rising tide, the rain, or a bucket of water will once again soften the sand and cause a disintegration of the sculpture. One preferred adhesive is pre-gelatinized starch powder that is prepared from corn or wheat. With a pH that is essentially neutral and a composition that is free of any anti-fungal or anti-bacterial preservative that would be considered an environmental pollutant, the starch is rapidly biodegradable and can be safely washed into waterways or into the ground water.

The prior art includes a number of systems for facilitating sand sculpting, but these systems have important limitations in terms of compositions and/or methods that the present invention is intended to overcome. For example, sand sculptures created using the systems of Demarzo in U.S. Pat. No. 6,126,876 and Kelly et al. in U.S. Pat. No. 5,730,293 lack an adhesive additive that would provide the surface durability and compressive strength of a sand composition that contains such an additive. Browning in U.S. Pat. No. 5,711,795 incorporates such an additive but the binder which is wax-based, is impractical to use at the beach, becoming insoluble in water upon drying, and is not readily dispersed or biodegraded in the environment. On the other hand, the cornstarch-containing receipes described on the Internet are not very useful at the beach or in the sandbox because the sand, cornstarch and water mixture must be cooked to activate the adhesive, and the proportion of cornstarch required in the recipe is large and therefore costly (approximately 1 cup cornstarch to 2 cups sand).

Weggel in U.S. Pat. No. 5,718,750 describes sand sculpting additives that are water-soluble, non-toxic and non-polluting. Either gelatin, ordinary cooking flour or corn starch is wetted with a small quantity of water "just sufficiently that it turns into sticky paste" which is then mixed with ordinary beach sand for building sand sculptures. While gelatin is the preferred adhesive, Weggel reports that the additive(s) becomes "dry and brittle, even after one adds water to the additive before mixing it with sand." In the case of gelatin, salt addition is reported to improve the texture of the additive. Compared to the starches, however, the current bulk price for gelatin is nearly ten-fold greater, averaging almost $2.00 per pound. Applicant has experimented with the recipes described by Weggel, and it is believed that the embrittlement problems are caused by the limited solubility of these additives in cold water. In fact, boiling is required to fully solubilize the flour starch and cornstarch described therein. Furthermore, having reproduced the sticky paste additives of Weggel, Applicant finds that the process of mixing this paste into sand to make a homogeneous mixture as described by Weggel can be cumbersome.

It is appreciated by those familiar with starch processing that gelatinization can beneficially modify the starch granule structure and reduce the amylose polymer content of the granule. This modification can render the starch and/or starch granules soluble in cold water. While gelatinizing starch on the kitchen stove is a routine procedure, it would be inconvenient to either carry pails of cooked wet starch or to prepare cooked starch at the beach for building sand castles. In the case of wheat, potato, corn and some other vegetable sources, pre-gelatinized forms of these starches are commercially available. Significantly, the pre-gelatinized starches are available in dried light weight forms that are easily transported to the beach and that are easily redissolved in cold water or moist beach sand. Pre-gelatinization can dramatically improve the utility of starches for sand sculpting, particularly when a cooking stove or very hot water is unavailable.

Therefore, to make sand sculpting practical and convenient at the beach (or in the sand box), the present invention utilizes pre-gelatinized starch that also has been dried and powdered. A measured amount of this starch can be readily mixed with a measured amount of dry sand that is then moistened with a measured amount of water. Alternatively, the starch may be mixed and dissolved in a measured amount of drained moist sand. Alternatively, the starch may be first dissolved in a measured amount of cold water to form a starch solution (not a paste) that is conveniently mixed with measured amount of dry sand. The present invention is intended to overcome the prior art limitations of using boiling water-soluble starch, e.g., cornstarch, and protein-based materials such as gelatin that are poorly soluble in cold water. It is empirically evident that the gelatinization process that promotes solubilization of the starch, also enhances the utility of starch as an agent for facilitating sand cohesion for sand sculpting. That is, upon drying of the starch solution that has been mixed with sand particles, the extensive network of solubilized starch molecules that adhere to the closely spaced grains of sand, provides the cohesive strength that allows sand sculpting.

Accordingly, Applicant has discovered a large class of cold water-soluble, cost-effective carbohydrate-based adhesives. These include not only the cold water-soluble starches, but also the cold water-soluble celluloses that are also ideally suited for sand sculpting. The starches may be either non-derivatized or chemically derivatized. Non-derivatized starches are, at a minimum, pre-gelatinized to render them soluble in cold water. Non-derivatized celluloses, on the other hand, are insoluble in both cold and hot water, and must be chemically derivatized to be useful in the present invention, i.e., to be rendered soluble in cold water.

Useful chemical derivatization of starch may include forming starch esters (replacing some hydroxyl groups with acetyl groups for example) and starch ethers (replacing some hydroxyl groups with hydroxymethyl, hydroxyethyl and hydroxypropyl groups for example). Similarly, cold water-soluble celluloses include acetyl or carboxymethyl and carboxyethyl-derivatized celluloses as well as the ether cellulose derivatives such as hydroxymethyl, hydroxyethyl and hydroxypropylcelluloses. Mixed ether and ester derivatives of the celluloses and starches, as well as blends of these derivatives are also feasible. The simplest and least expensive of these cold water-soluble carbohydrate polymers are however, the chemically unmodified starches that have been altered only by pre-gelatinization. The pre-gelatinized starches are also known as instant starches, or cold water swelling starches and are made by swelling the native starch granules using controlled heating and/or mild chemical treatment in an aqueous medium to produce gelatinized starch. The pre-gelatinized starch granules are altered by physical leaching of some of their amylose content and by hydration of the amylopectin (leading to maximum viscosity when the granules are maximally hydrated). The pre-gelatinized starches that are commercially available are typically prepared from high carbohydrate content agricultural crops including wheat, corn, rice, tapioca, potatoes and peas. These starches (polymers of anhydro-alpha-D-glucose residues) tend to vary in their proportions of linear structured amylose chains and branched structured amylopectin. In general, to produce the characteristic of cold water solubility, these starches need only be pre-gelatinized. This term implies that the starch granules have been gelatinized as described above, then dried (by spray-drying, drum-drying or by extrusion) and finally granulated, powdered or flaked for rapid dispersal in cold water. Soluble starches have been used in diverse applications ranging from adhesive coatings for retaining printing inks, to sizing additives for textile fibers and textile finishing, to adhesives for hanging wallpapers and posters.

The current bulk price of chemically unmodified, pre-gelatinized wheat, potato or cornstarch is approximately $0.30–$0.40 per pound. This price makes pre-gelatinized starch a particularly attractive alternative to gelatin that is currently priced at $2.00 or greater per pound and to soy protein polymer adhesives or casein-based adhesives that are also much more expensive than starch. The chemically derivatized starches and celluloses are likewise considerably more expensive than simple gelatinized starch, ranging in price from approximately $0.90 to $1.50 per pound. Significantly, regardless of the choice of adhesive from the above varieties of water-soluble adhesives, Applicant has determined that a sufficient proportion by weight of adhesive solids must be included in the aqueous coating of the sand to prevent crumbling once the sand has dried. It is estimated that at least 0.25% by weight and preferably between 0.5% and 1% by weight of dry adhesive, relative to the dry weight of sand must be dissolved in the aqueous coating to be effective in adequately fortifying the sand for sand sculpting. Since pre-gelatinized starch powder is easy to use, nearly neutral in pH, non-irritating to the skin, non-toxic, biodegradable, non-polluting, and inexpensive it may be difficult to find a better adhesive for sand sculpting. As a dry powder it is also readily combined with sand to create a sand sculpting composition by either:

(i) dispersing the powder in dry or slightly damp sand prior to adding water to the sand and mixing, or (ii) dissolving the powder in a premeasured quantity of cold water to form a solution (it need not form a paste that makes dispersal in sand more difficult) which is then readily mixed with the sand.

The pre-gelatinized unmodified starches (as well as the chemically modified starches and celluloses) are child-safe, i.e., non-toxic, and are commercially available in forms having essentially neutral pH value when dissolved in water so that they are non-irritating to the skin even after prolonged contact. Soluble starches and celluloses are biodegradable and mildly nutritive for marine life. They are safely leachable by rainwater into lakes, streams and waterways, or by the rising tide into oceans and estuaries. It is preferable to select starch and/or cellulose-containing adhesive compositions that do not contain mold inhibitors or other biocides so as to minimize any environmental impact accompanying such leaching into groundwater, streams and the like. Providing that the sand sculpting additives are stored dry before using, there is little opportunity for these compositions to support mold or bacterial growth. If moisture is problematic during storage in certain environments, one essentially non-toxic preservative that may be considered for addition to starch or cellulosic powders for retarding or preventing bacterial and mold gowth is EDTA. The disodium or dipotassium form of EDTA (also added to foods as a preservative), may be added at a concentration of approximately 0.02%–0.04% by weight of dry adhesive.

Together with adhesive, coloring agents can be added to the sand sculpting compositions described herein. For example, a non-toxic water-dispersible paint powder such as tempera paint powder (or the non-toxic mineral and/or organic pigment portion of tempera paint) may be added to sand either as a pigment-adhesive powder blend, or as an ingredient separate from the powdered adhesive. For preparing blended mixtures of powder adhesive and pigment, it may be helpful to add an inert, non-toxic and "environmentally friendly" dispersing agent to the pigment (also termed a "carrier" or "extender") to improve the pigment's efficacy in coloring the final sand mixture. One common example of such a pigment-dispersing agent is calcium carbonate powder. The weight proportion of dispersing agent to pigment may be determined for each pigment by routine experimentation. Additionally, the weight proportion of pigment (or pigment plus dispersing agent) versus adhesive is determined based upon cost considerations and coloration preference, i.e., the degree of sand coloration desired. If it is preferred, a pigment or dye color may be added to the surface of the sand sculpture after being formed, rather than to its entire volume. Accordingly, the sand can be "painted," using, for example, a hand pump sprayer holding a water-borne pigment after the sculpture has been formed. Tempera paint powders, for example, have been obtained from Binney and Smith Inc., Easton, Pa. and Sargent Art, Inc., Hazleton, Pa.). They are inexpensive, and when added at a level of approximately 2% by volume based upon amount of sand (e.g., 1 tsp of tempera powder per cup of sand), provide a visually attractive level of color in white beach sand. When a concentrated pigment is used rather than a blended tempera paint powder, the amount of color material added is considerably reduced. The amount of color can be adjusted upward or downward without significantly affecting the ability of the carbohydrate-based adhesives to induce cohesion of the sand particles when water is introduced into the mixture.

Colored adhesive-containing moist sand-based compositions described herein may also be used to create sand paintings or bas-relief forms on the beach, in the sandbox or even on art rendering surfaces such canvas, cardboard or wooden support surfaces. In this manner, following drying, a substantially permanent two dimensional sand treatment may be created.

In a first aspect of the invention there is provided a sand sculpting composition that includes approximately 100 parts by dry weight of sand, between 0.1 part and 5 parts by dry weight of a non-toxic cold water-soluble adhesive agent selected from the group consisting of pre-gelatinized starches, chemically modified starches and chemically modified celluloses, and between 6 and 25 parts by weight water, in which the adhesive agent has been combined with the sand and an amount of water sufficient to both dissolve the adhesive agent and allow the adhesive agent to coat the particles of sand.

In an embodiment of this aspect, the sand sculpting composition has been compressed into a substantially two dimensional or three-dimensional shaped form and allowed to dry and harden. For example, a substantially two dimensional bas-relief or sand painting form can be created on a surface such as wood, cardboard, canvas, or paper or, alternatively, a three dimensional house, sand castle or figure of an animal or person can be created at the beach or in a sandbox.

In another embodiment, at least a portion of the sand sculpting composition becomes substantially anhydrous owing to water evaporation.

In another embodiment, the dried and hardened shaped sand form is contacted by an excess quantity of water causing the dried adhesive agent to dissolve, resulting in the shaped form disintegrating. This excess quantity of water may be provided by a water source selected from the group consisting of a water bucket, water hose, rain, and rising ocean tide.

In another embodiment, the sand sculpting composition above contains between 0.2 and 1 part by weight of the adhesive agent.

In another embodiment, the adhesive agent is a dry particulate adhesive agent selected from the group consisting of granular, flaked and powdered adhesive agents.

In yet another embodiment,the above sand sculpting composition includes between 10 and 20 parts by weight water.

In another embodiment, the sand sculpting composition includes at least one pre-gelatinized starch or chemically modified starch that is derived from a vegetable source selected from the group consisting of wheat, corn, rice, tapioca, potatoes, peas and combinations thereof. The chemically modified starch is selected from the group consisting of starch ethers and starch esters.

In yet another embodiment, the adhesive agent is a chemically modified cellulose selected from the group consisting of cellulose ethers and cellulose esters.

In another aspect, the invention features a colored adhesive sand additive composition that includes one part by weight of a non-toxic cold water-soluble adhesive agent selected from the group consisting of pre-gelatinized starches, chemically modified starches and chemically modified celluloses, and between 0.01 part and 5 parts by weight of a non-toxic cold water-dispersible coloring agent.

In one embodiment, the colored adhesive composition includes a non-toxic coloring agent that can be a dry powdered paint, a pigment or a dye, and the adhesive agent is a dry particulate adhesive agent selected from the group consisting of granular, flaked and powdered adhesive agents. The term "pigment" generally refers to a coloring agent that can provide substantial opacity to a medium while the term "dye" refers to a coloring agent that can transmit light, albeit colored light. Both inorganic, i.e., mineral-based colorants, as well as organic colorants may be selected for use in the presently described compositions. In a related embodiment, the powdered paint is a tempera paint. In another embodiment, the final pH of the sand sculpting composition is between pH 5 and pH 9. Preferably, the final pH of the sand sculpting composition is between pH 6 and pH 8.

In another embodiment, the sand sculpting composition is free of any toxic preservatives.

In a related embodiment, the sand sculpting composition includes a preservative selected from the group consisting of the free acid and salt forms of EDTA, free acid and salt forms of propionic acid, and free acid and salt forms of sorbic acid.

In another aspect, the present invention features a kit for making the sand sculpting composition describes above, in which the kit includes at least one non-toxic cold water-soluble dry particulate adhesive agent selected from the group consisting of pre-gelatinized starches, chemically modified starches and chemically modified celluloses, in addition to user instructions for mixing a first quantity of sand with a second quantity of the above adhesive agent and a third quantity of water to make the sand sculpting composition.

In one embodiment, the kit includes at least one accessory device selected from the group consisting of volumetric measuring devices, sand sculpting tools, shape-forming molds, and decorative architectural and anatomical accessory elements. For example, without limitation, examples of such decorative elements may include injection-molded plastic doors, windows, roofing, draw-bridges, turrets and the like for sand castles and houses, or alternatively wigs, clothing elements and anatomical elements such as eyes, ears, mouths and noses for creating human or animal-like figures.

In a related embodiment, the measuring device is sized for measuring out a sand sculpting ingredient selected from the group consisting of an adhesive agent, a coloring agent, sand, water, and combinations thereof.

In another aspect, the invention features a kit for making a colored sand sculpting composition. The kit includes at least one non-toxic, cold water-soluble dry particulate adhesive agent selected from the group consisting of pre-gelatinized starches, chemically modified starches and chemically modified celluloses, at least one non-toxic coloring agent that optionally may be pre-mixed with said adhesive agent, and user instructions for mixing a first quantity of sand with a second quantity of the adhesive agent, a third quantity of the coloring agent that optionally may be pre-mixed with the adhesive, and a fourth quantity of water to make the colored sand sculpting composition.

In one embodiment, the kit further includes at least one accessory device selected from the group consisting of volumetric measuring devices and sand sculpting tools, and shape-forming molds.

In another embodiment, the kit includes a volumetric measuring device that is sized for measuring out a sand sculpting ingredient selected from the group consisting of an adhesive agent, a coloring agent, sand, water, and combinations thereof.

In yet another aspect, the invention features a method of enhancing the cohesion of sand particles, the method including the steps of providing and combining approximately 100 parts by dry weight of sand, between 0.1 part and 5 parts by dry weight of a non-toxic cold water-soluble adhesive agent selected from the group consisting of pre-gelatinized starches, chemically modified starches and chemically modified celluloses, and between 6 and 25 parts by weight water, and thoroughly mixing the water, adhesive agent, and sand to form a generally homogeneous and cohesive mixture.

In one embodiment, the method further includes the step of compressing the cohesive mixture to create a substantially two or three-dimensional shaped form and then allowing the form to dry and harden. Colored and non-colored sand paintings and bas-relief shaped sand surfaces would be considered two dimensional forms while sculpted animal figures, houses and sand castles would be considered three dimensional forms.

In another embodiment, the method includes using an amount of water that is sufficient for both dissolving the adhesive agent and allowing the adhesive agent to coat essentially all of the particles of sand.

In yet another embodiment, the amount of adhesive agent in the sand sculpting mixture is chosen to be adequate for preventing crumbling of the three-dimensional shaped form under a static load of at least 4 psi after the form has dried.

In a preferred embodiment, the amount of adhesive agent in the sand sculpting mixture is chosen to be adequate for preventing crumbling of the shaped form under a static load of at least 10 psi after the form has dried.

In another embodiment, the addition of water to the sand sculpting composition described above is omitted, if a moist sand having a water content in this same range (6 to 25 parts of water per 100 parts of dry sand) is provided rather than a dry sand.

BRIEF DESCRIPTION OF THE SEVERAL VIEWS OF THE DRAWING

None

DETAILED DESCRIPTION OF THE INVENTION

Definitions. As used in this description and the accompanying claims, the following terms shall have the meanings indicated, unless the context otherwise requires:

The term "cold", e.g., in the expression "cold water-soluble", means the temperature of any readily available water in the natural environment that is not artificially heated, whether it is cold water in Canada, or warm water in Mexico, and whether it is obtained from a fresh water lake or from a salt water ocean, or from a water faucet at home, for example. The term is meant to be distinguished from "hot water" in which a stove or other heating device is needed to heat the water. For example, non-gelatinized cornstarch is soluble in water only after it has been heated to nearly 100 degrees Centigrade.

The term "adhesive" refers to a glue-like agent that can bond to sand. In the context of the present invention, the adhesive is water-soluble, and when the water carrying the adhesive agent evaporates from the sand, the adhesive agent dries and bonds, i.e., adheres, to the sand particles. When the moist sand that has been coated with an adhesive agent (such as pre-gelatinized starch) is compressed together and then dries, the adhesive agent causes the sand particles to bond to one another, i.e., to "cohere".

The term "free acid and salt forms of EDTA, propionic acid, and sorbic acid" refer to commercially available, water-soluble forms of these preservatives, including edetic acid, disodium ethylenediaminetetraacetate, sodium propionate and potassium sorbate.

The term "sand" refers to a generally loose particulate material whose grains are usually less than 2 mm in diameter, commonly of the minerals quartz or calcium carbonate, and usually resulting from either the natural disintegration or from the crushing of rock and sea coral. In the present invention, such sands can be used to form temporary sculptures.when combined with one or more cold water-soluble adhesive agents.

The term "tempera" refers to a water-dispersible type of paint in which typically an albuminous or colloidal medium is employed as a vehicle instead of oil.

The term "volumetric measuring device" refers to a device that is useful for measuring out ingredients used in sand sculpting compositions. For example, graduated volumetric cylinders holding between 100 ml and 1000 ml are useful for measuring and dispensing an amount of water needed for preparing between approximately one cup and 2 gallons of a sand sculpting composition, while teaspoon, tablespoon and cup volumetric measures are useful for measuring out a powdered adhesive. For example, one cup of sand may require 3 g of adhesive (approximately 1 tsp of dry pre-gelatinized starch) and 50 ml of water to form a useful sand sculpting composition, while one gallon of sand may require ⅓ cup of this starch and 800 ml of water.

The term "sand sculpting tool" refers to a plastic, wood or metal instrument that may be useful in the shaping and crafting of sand sculptures. Smooth or serrated spoons and spatulas are examples of such sculpting tools that may be useful for scraping, texturing and hollowing out molded sand forms.

The term "sand castle molds" refers to receptacles for molding sand shapes, e.g., molds for making architectural forms such as towers, walls and houses. The molds are typically made from molded plastic or rubber materials, and are suitably shaped to permit release of the sand object formed inside the mold. In typical use, some of the moist sand sculpting composition is loaded into the mold and compressed by hand. After compression, the mold is turned upside down and the formed sand shape can be dropped out or shaken from the mold.

EXAMPLE 1

Prior Art Sand Sculpting Compositions

Two prior art sand sculpting compositions described by Weggel in U.S. Pat. No. 5,718,750 were formulated and tested for sand cohesion. Either one teaspoon (3.0 g) of conventional corn starch (Argo®brand, Bestfoods, Englewood Cliffs, N.J.) or one-half teaspoon (1.8 g) of gelatin (Knox Company, Parsippany, N.J.), was hydrated (not dissolved) in cool water to form pastes, and then mixed with one cup of sand (375 g). The final amount of water combined into the sand was 50 ml (at room temperature). After thorough blending, the mixtures were compressed into a plastic cup to form or "sculpt" the sand. These cup-shaped sand forms were shaken from the mold and allowed to dry. The weight proportions of adhesive used based upon dry weight of sand (0.8% for cornstarch and 0.5% for gelatin) are estimated at approximately twice that amount taught by Weggel. Upon drying, the gelatin-containing sand was judged to have a moderately useful degree of cohesion for sculpting, but the cornstarch-containing sand exhibited almost no discernable cohesion. This experiment was repeated, except that Applicant added the step of boiling the gelatin-water and cornstarch-water mixtures before mixing with the sand. This alteration produced much more cohesive sand structures both initially (when the sand was still wet) as well as upon drying. This result is consistent with Applicant's hypothesis that only complete solubilization of an adhesive, whether it is starch or protein-based, allows optimal sand cohesion. In the case of starches, this solubilization can be achieved in cold water provided that the starch has been pre-gelatinized during manufacturing. As indicated earlier, the high cost of protein-based adhesives compared to starches and celluloses makes gelatin a relatively impractical adhesive for sand sculpting applications.

EXAMPLE 2

Sand Sculpting Compositions Utilizing Pre-Gelatinized Cornstarches

Three pre-gelatinized cornstarches (chemically underivatized) were obtained from the Chemstar Products Company (Minneapolis, Minn.). In pallet quantities of approximately 2500 pounds, these three starches (Fiberstar C, C+, and CX+) are priced respectively at $0.36, $0.39 and $0.52 per pound. These powdered preparations contain no preservatives, and when dissolved in cold water at a concentration of 6% by weight, the solution pHs ranged from 6 to 7. Prolonged hand contact with these solutions caused no skin irritation, and eyelid contact produced no burning sensation or reddening. Therefore, in addition to being non-toxic, these starches appear to be child-safe. Each dry starch was blended into either dry course sand or dry fine beach sand at a rate of 3.0 g per 375 g sand. 50 ml of cool water was added to the starch-sand mixture, which was then re-blended. Alternatively, the starch was initially dissolved in the cold water, and the resulting starch solution was thoroughly mixed with the sand. The moist sands were formed and compressed into a 1 cup plastic measure. The cup-shaped sand forms were released onto a sheet of aluminum foil and allowed to dry. When dry, the degree of sand particle cohesion was tested by the cake's ability to resist marking or breaking of the sand's upper surface under fingernail pressure, as well as the resistance of the cake's side surface to sand loss during fingernail scraping. While all pre-gelatinized starches produced well cohered coarse sands and fine sands, the C+ and CX+ starches were superior to C. It is believed that the superior starches possess a somewhat greater viscosity and retain a greater degree of hydrocolloid particle structure in solution. Even reducing the adhesive concentrations to 0.4% by weight, i.e., 1.5 g adhesive per 375 g of dry sand, produces satisfactory sand cohesion, although the resulting sand structures are not as resistant to impacts and cannot support quite as much weight. For example, all of the cup-shaped molded sand structures (1 cup volumes) supported static weights in excess of 4 pounds, balanced on 1 square inch of the sand's surface. In fact, the sands containing C+ and CX+ starches added at dry weight concentrations of 0.8% supported in excess of 20 pounds per square inch of sand surface without the sand crumbling. To dispose of the hardened sand forms, the forms were simply soaked in cold water causing almost immediate disintegration.

EXAMPLE 3

Sand Sculpting Compositions Utilizing Pre-Gelatinized Wheat Starch

One sample of pre-gelatinized dry wheat-based starch (chemically underivatized starch) was obtained from Roman Adhesives, Inc. (Calumet City, Ill.). This powdered preparation known as "Golden Harvest Vinyl Wallcovering Paste" when dissolved in water at a concentration of 7% by weight has a pH of approximately 7.5. A coarse sand mixture was constituted as in Example 2 except that 3.5 g of the wheat starch was combined with 375 g of sand and 50 ml of water. Alternatively, the wheat starch was first combined with the water, and then mixed with the sand. In either case, the resulting mixtures were thoroughly blended by spoon, hand-compressed into a plastic one cup measure, released from the cup and dried as above. The resulting dried sand cake showed excellent hardness and durability. Subsequent soaking in cold water caused almost immediate disintegration as described above for the corn adhesives. This wheat-based adhesive is commercially available with or without a preservative. The latter is preferred so that the adhesive may be considered child-safe and environmentally safe for discharge into waterways.

EXAMPLE 4

Sand Sculpting Compositions Utilizing Chemically Derivatized Potato Starch Ethers Three different commercial sources of carboxymethyl potato starch ethers provided a variety of anionic potato starch ether polymers. The cost of these products in bulk is approximately $0.90 per pound, or about twice the price per pound of simple pre-gelatinized starches. The products were as follows: Glucostar 430 from Chemstar Products Company (Minneapolis, Minn.), Emcol AX from Emsland-Starke GMBH in Germany, and Golden Harvest Teknabond Multipurpose Dry Pro (Calumet City, Ill.). When dissolved at a concentration of 4% in water, these products have pHs ranging from approximately 10 to 11. This is because the potato starches have been alkaline-treated during their manufacture. This alkalinity can cause mild skin irritation and eye irritation, so that these products are less desirable for children's uses. Nevertheless, for each of these three powdered adhesives, 3 g adhesive (0.8% based upon dry weight of sand) was mixed with 1 cup (375 g) of coarse sand, followed by addition of 50 ml of cold water. Following blending, the moist sands were molded and then released from a plastic one cup measure, and then allowed to dry. All adhesives produced satisfactory results, but the sand cohesion results from the Emcol AX and the Teknabond products were superior to the Glucostar 430 product. Sand cohesion resulting from one-half as much adhesive, i.e., 0.4% based upon dry weight of sand, was unacceptable for Glucostar 430 (dry cake easily crumbled) but acceptable for the Teknabond and Emcol AX products.

EXAMPLE 5

Sand Sculpting Compositions Utilizing Chemically Derivatized Cellulose Adhesives Three different chemical derivatives of cellulose including hydroxypropyl methylcellulose (Methocel® OS, Dow Chemical Company, Midland, Mich.), hydroxyethylcellulose MR (Cellosize®, Union Carbide, Danbury, Conn.), and sodium carboxymethylcelluose 7MF (Hercules, Aqualon Division, Wilmington, Del.) were each added to dry sands @ 0.8% by weight. These dry powdered adhesives were mixed with coarse dry sand according to the method described in Example 4 (approximately 3 g adhesive per cup of sand). All of these adhesives were found to be "user-friendly," given that the powders were easily mixed with sand, rapidly dissolved when water was added, and produced moistened sand mixtures having nearly neutral pHs. All of these adhesives provided satisfactory cohesion of sand. The concentration of one of the adhesives (sodium carboxymethylcelluose 7MF) was varied over a four-fold range to determine the minimum but sufficient concentration required for adequate sand cohesion. Accordingly, this adhesive was added to both coarse and fine silica-based sands at concentrations of 1%, 0.5% and 0.25% by weight based upon the dry weight of the sands (50 ml of water was maintained constant per cup of sand). Remarkably, even the lowest concentration, 0.25%, proved sufficient for producing essentially rock-hard sand forms after the water had evaporated from the sand. However, a significant decrease below 0.25%, i.e., 0.10%, produced dried sand sculptures that were susceptible to crumbling when squeezed between the fingers.

All patents and publications mentioned in the specification are indicative of the levels of skill of those skilled in the art to which the invention pertains. All references cited in this disclosure are incorporated by reference to the same extent as if each reference had been incorporated by reference in its entirety individually.

One skilled in the art would readily appreciate that the present invention is well adapted to carry out the objects and obtain the ends and advantages mentioned, as well as those inherent therein. The specific methods and compositions described herein as presently representative of preferred embodiments are exemplary and are not intended as limitations on the scope of the invention. Changes therein and other uses will occur to those skilled in the art which are encompassed within the spirit of the invention are defined by the scope of the claims.

It will be readily apparent to one skilled in the art that varying substitutions and modifications may be made to the invention disclosed herein without departing from the scope and spirit of the invention. For example, those skilled in the art will recognize that the invention may suitably be practiced using any of a variety of sources of said polymer treatment liquids.

The invention illustratively described herein suitably may be practiced in the absence of any element or elements, limitation or limitations which is not specifically disclosed herein. Thus, for example, in each instance herein any of the terms "comprising," "consisting essentially of" and "consisting of" may be replaced with either of the other two terms. The terms and expressions which have been employed are used as terms of description and not of limitation, and there is not intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group. For example, if there are alternatives A, B, and C, all of the following possibilities are included: A separately, B separately, C separately, A and B, A and C, B and C, and A and B and C. Thus, the embodiments expressly include any subset or subgroup of those alternatives, for example, any subset of the types of polymer treatment liquids. While each such subset or subgroup could be listed separately, for the sake of brevity, such a listing is replaced by the present description.

While certain embodiments and examples have been used to describe the present invention, many variations are possible and are within the spirit and scope of the invention. Such variations will be apparent to those skilled in the art upon inspection of the specification, drawings and claims herein.

Other embodiments are within the following claims.

What is claimed is:

1. A sand sculpting composition comprising for arts and crafts and creative play use approximately 100 parts by dry weight of sand, between 0.1 part and 5 parts by dry weight of at least one non-toxic cold water-soluble adhesive agent selected from the group consisting of pre-gelatinized starches, chemically modified starches and chemically modified celluloses, and more than about 6 and up to about 25 parts by weight water, wherein said adhesive agent has been combined with said sand and an amount of water sufficient to both dissolve said adhesive agent and allow said adhesive agent to coat the particles of said sand.

2. The sand sculpting composition of claim 1 wherein said composition has been compressed into a substantially two or three-dimensional shaped form and allowed to dry and harden.

3. The sand sculpting composition of claim 1 wherein at least a portion of said composition becomes substantially anhydrous owing to water evaporation.

4. The sand sculpting composition of claim 1 comprising between 0.2 and 1 part by weight of said adhesive agent.

5. The sand sculpting composition of claim 1 wherein said adhesive agent is a dry particulate adhesive agent selected from the group consisting of granular, flaked and powdered adhesive agents.

6. The sand sculpting composition of claim 1 comprising between 10 and 20 parts by weight water.

7. The sand sculpting composition of claim 1 wherein said pre-gelatinized starches and chemically modified starches are derived from a vegetable source selected from the group consisting of wheat, corn, rice, tapioca, potatoes, peas and combinations thereof.

8. The sand sculpting composition of claim 1 wherein said adhesive agent is a chemically modified starch selected from the group consisting of starch ethers and starch esters.

9. The sand sculpting composition of claim 1 wherein said adhesive agent is a chemically modified cellulose selected from the group consisting of cellulose ethers and cellulose esters.

10. The composition of claim 1 wherein the non-toxic cold water-soluble adhesive agent is provided in an amount of 1 part by weight and further comprising between 0.01 part and 5 parts by weight of a non-toxic cold water-dispersible coloring agent.

11. The composition of claim 10, wherein said coloring agent comprises a dry powdered pigment or dye and said adhesive agent is a dry particulate adhesive agent selected from the group consisting of granular, flaked and powdered adhesive agents.

12. The composition of claim 10, wherein said coloring agent is a tempera paint.

13. The sand sculpting composition of claim 1 wherein the final pH of said composition is between pH 5 and pH 9.

14. The sand sculpting composition of claim 1 wherein the final pH of said composition is between pH 6 and pH 8.

15. The sand sculpting composition of claim 1 wherein said composition is free of any toxic preservatives.

16. The sand sculpting composition of claim 1 wherein said composition comprises a preservative selected from the group consisting of the free acid and salt forms of EDTA, free acid and salt forms of propionic acid, and free acid and salt forms of sorbic acid.

17. A kit for making the sand sculpting composition of claim 1, said kit comprising at least one non-toxic cold water-soluble dry particulate adhesive agent selected from the group consisting of pre-gelatinized starches, chemically modified starches and chemically modified celluloses, and user instructions for mixing a first quantity of sand with a second quantity of said adhesive agent and a third quantity of water to make said sand sculpting composition.

18. The kit of claim 17 further comprising at least one accessory device selected from the group consisting of volumetric measuring devices, sand sculpting tools, sand castle molds, and decorative architectural and anatomical accessory elements.

19. The kit of claim 18 wherein a measuring device is sized for measuring out a sand sculpting ingredient selected from the group consisting of an adhesive agent, a coloring agent, sand, water, and combinations thereof.

20. A kit for making a colored sand sculpting composition, said kit comprising at least one non-toxic cold water-soluble dry particulate adhesive agent selected from the group consisting of pre-gelatinized starches, chemically modified starches and chemically modified celluloses, at least one non-toxic coloring agent that optionally may be pre-mixed with said adhesive agent, and user instructions for mixing a first quantity of sand with a second quantity of said adhesive agent, a third quantity of said coloring agent that optionally may be pre-mixed with said adhesive, and a fourth quantity of water to make said colored sand sculpting composition.

21. The kit of claim 20 further comprising at least one accessory device selected from the group consisting of volumetric measuring devices, sand sculpting tools, sand castle molds, and decorative architectural and anatomical accessory elements.

22. The kit of claim 21 wherein a measuring device is sized for measuring out a sand sculpting ingredient selected from the group consisting of an adhesive agent, a coloring agent, sand, water, and combinations thereof.

23. A method of enhancing the cohesion of sand particles, the method comprising the steps of providing and combining approximately 100 parts by dry weight of sand, between 0.1 part and 5 parts by dry weight of a non-toxic cold water-soluble adhesive agent selected from the group consisting of pre-gelatinized starches, chemically modified starches and chemically modified celluloses, and more than about 6 and up to about 25 parts by weight water, and combining said water, said adhesive agent, and said sand to form a generally homogeneous and cohesive mixture.

24. The method of claim 23 wherein a shape formed from said mixture is contacted by an excess quantity of water causing the dried adhesive agent to dissolve and said shaped form to disintegrate.

25. The method of claim 24 wherein said excess quantity of water is provided by a water source selected from the group consisting of a water bucket, water hose, rain, and rising ocean tide.

26. The method of claim 23 further comprising the step of compressing said mixture to create a substantially two or three-dimensional shaped form and allowing said form to dry and harden.

27. The method of claim 26 wherein the amount of adhesive agent in said mixture is chosen to be adequate for preventing crumbling of said form under a static load of at least 4 psi after said form has dried.

28. The method of claim 26 wherein the amount of adhesive agent in said mixture is chosen to be adequate for preventing crumbling of said form under a static load of at least 10 psi after said form has dried.

29. The method of claim 23 wherein the amount of water is chosen to be sufficient for both dissolving said adhesive agent and allowing said adhesive agent to coat essentially all of the particles of said sand.

30. The method of claim 23 wherein the addition of between 6 and 25 parts by weight water is omitted when a moist sand having a water content in this same range is provided, rather than a dry sand.

* * * * *